US007817806B2

(12) United States Patent
Nakano

(10) Patent No.: US 7,817,806 B2
(45) Date of Patent: Oct. 19, 2010

(54) SOUND PICKUP METHOD AND APPARATUS, SOUND PICKUP AND REPRODUCTION METHOD, AND SOUND REPRODUCTION APPARATUS

(75) Inventor: Kenji Nakano, Kanagawa (JP)

(73) Assignee: Sony Corporation (JP)

( * ) Notice: Subject to any disclaimer, the term of this patent is extended or adjusted under 35 U.S.C. 154(b) by 1196 days.

(21) Appl. No.: 11/126,894

(22) Filed: May 10, 2005

(65) Prior Publication Data

US 2005/0259832 A1 Nov. 24, 2005

(30) Foreign Application Priority Data

May 18, 2004 (JP) ..... P2004-147600

(51) Int. Cl.
*H04R 3/00* (2006.01)

(52) U.S. Cl. ..... 381/92; 92/26; 92/122

(58) Field of Classification Search ..... 381/1, 381/17–18, 309–310, 26, 74, 122, 91–92, 381/56; 700/245, 258
See application file for complete search history.

(56) References Cited

U.S. PATENT DOCUMENTS

| | | | | |
|---|---|---|---|---|
| 4,817,153 | A * | 3/1989 | Fernandez | 381/26 |
| 5,325,436 | A * | 6/1994 | Soli et al. | 381/313 |
| 6,021,206 | A * | 2/2000 | McGrath | 381/310 |
| 6,259,795 | B1 * | 7/2001 | McGrath | 381/310 |
| 7,515,992 | B2 * | 4/2009 | Sawada et al. | 700/245 |

FOREIGN PATENT DOCUMENTS

| | | | |
|---|---|---|---|
| JP | 63-051800 | A | 3/1988 |
| JP | 4-132468 | A | 5/1992 |
| JP | 08-084286 | A | 3/1996 |
| JP | 09-070094 | A | 3/1997 |
| JP | 10-023600 | A | 1/1998 |
| JP | 11-262097 | A | 9/1999 |
| JP | 2000-004493 | A | 1/2000 |
| JP | 2000-165718 | A | 6/2000 |
| JP | 2001-169309 | A | 6/2001 |
| JP | 2002-271885 | A | 9/2002 |
| JP | 2003-264900 | A | 9/2003 |
| JP | 2003-319499 | A | 11/2003 |
| JP | 2005-124090 | A | 5/2005 |
| JP | 2005-159731 | A | 6/2005 |
| JP | 2005-277832 | A | 10/2005 |
| JP | 2006-503526 | A | 1/2006 |

* cited by examiner

*Primary Examiner*—Devona E Faulk
*Assistant Examiner*—Disler Paul
(74) *Attorney, Agent, or Firm*—Lerner, David, Littenberg, Krumholz & Mentlik, LLP

(57) ABSTRACT

A sound is picked up using a plurality of microphones that are arranged so that respective directivity axes of the microphones differ from each other or so that they function as a plurality of microphones having directivities in different directions by performing a calculation on sound signals output from the plurality of microphones. Rotation of the plurality of microphones is detected, and the sound signals output from the plurality of microphones are processed according to the detected rotation so that a change in orientation of each of the microphones is canceled. The processed output sound signals are output to a reproduction side.

13 Claims, 19 Drawing Sheets

SOUND PICKUP METHOD AND APPARATUS, SOUND PICKUP AND REPRODUCTION METHOD, AND SOUND REPRODUCTION APPARATUS

CROSS REFERENCES TO RELATED APPLICATIONS

The present invention contains subject matter related to Japanese Patent Application JP 2004-147600 filed in the Japanese Patent Office on May 18, 2004, the entire contents of which are incorporated herein by reference.

BACKGROUND OF THE INVENTION

1. Field of the Invention

The present invention relates to a method and apparatus for sound pickup using a plurality of microphones, and to a method and apparatus for sound reproduction using loudspeakers or headphones based on a sound signal picked up by the sound pickup method and apparatus.

2. Description of the Related Art

Binaural recording is one sound pickup method for recording sound from sound sources placed in an acoustic space while maintaining information about the direction of incoming sound.

Another sound pickup method other than binaural recording for recording sound from sound sources while maintaining information about the direction of incoming sound is to use multiple directional microphones as pickup microphones.

In the multi-directional microphone method, a plurality of, e.g., three, directional microphones are placed with their directional ranges covering different areas for individually picking up sound from different areas. In the sound reproduction side, a plurality of, e.g., three, loudspeakers are placed similarly to the pickup areas for reproducing and outputting sound to a listener.

If the microphones have insufficient directional selectivity, a matrix operation is performed on sound signals output from the microphones to obtain sharper directivity, resulting in high spatial resolution during sound reproduction. A directional characteristic is produced by a matrix operation, and therefore an omni-directional microphone may be used as a pickup microphone.

Such a multi-directional microphone method (including the use of omni-directional microphones, in which a directional characteristic is produced by a matrix operation) is advantageous over the binaural method to give a natural auditory sensation to a listener who changes his/her head orientation during sound reproduction as if he/she changes his/her head orientation in the recording site.

Japanese Unexamined Patent Application Publication No. 2002-271885 discloses a microphone system having three pairs of microphones placed around a reference microphone, in which sound signals output from the microphones are subjected to digital signal processing to control the directional characteristics of the microphones.

Japanese Unexamined Patent Application Publication No. 9-70094 discloses a headphone apparatus that detects motion of the head of a listener who wears a headphone and that processes multi-channel sound signals depending upon the orientation of the listener's head to localize the sound image outside the listener's head in front of or behind the listener.

SUMMARY OF THE INVENTION

With recent compact recording devices, high-performance signal processors, large-capacity recording media, etc., it is common to record sound, such as environmental sound, using a plurality of microphones together with information about the direction of incoming sound in an informal, simple, unconscious manner to experience the recorded sound later and to share the experience with others through communication over a network.

In such a recording scene, the orientation of the microphones may frequently be changed during sound pickup.

FIG. 19 illustrates a recording scene in which an operator 7 who is walking on a street 9 in the direction indicated by an arrow takes environmental views or landscape views ahead using a video camera 8 and records surrounding sounds and noises using a multi-microphone device 2 mounted on the operator's head. The multi-microphone device 2 is composed of, for example, three directional microphones having directional axes with intervals of 120 degrees. In this recording scene, if the operator 7 changes his/her head orientation by looking around, the multi-microphone device 2 also rotates to change these three microphones of the multi-microphone device 2.

In either binaural recording or multi-directional microphone recording, when sound is picked up using a plurality of microphones, the orientation of the microphones should not be changed during sound pickup because the change in orientation contributes to listener's confusion about auralization of the sound field during sound reproduction.

Specifically, in a multi-directional microphone system, as shown in FIG. 18, output sound signals from three microphones 1*a*, 1*b*, and 1*c* are transmitted to the sound reproduction side, and the transmitted sound signals are supplied to loudspeakers 4*a*, 4*b*, and 4*c* in the sound reproduction side. In this case, a listener 5 listens to the sound picked up as sound from a point Pr being output from a point Pp corresponding to the point Pr. However, if the multi-microphone device 2 formed of the microphones 1*a*, 1*b*, and 1*c* rotates in a certain direction indicated by an arrow 3 during sound pickup, in the sound reproduction side, the sound field rotates in the opposite direction to the rotation direction of the multi-microphone device 2, as indicated by an arrow 6.

For sound pickup using a plurality of microphones, therefore, it is necessary to fix the microphones during sound pickup, which is not suitable for the informal recording described above.

It is therefore desirable to suppress the listener's confusion about auralization of the sound field during sound reproduction, which is caused by a change in orientation of microphones during sound pickup, when sound is picked up by a multi-directional microphone system and is transmitted to the sound reproduction side and the sound is reproduced using loudspeakers or headphones in the sound reproduction side.

A sound pickup method according to an embodiment of the present invention includes the steps of picking up sound using a plurality of microphones, the plurality of microphones being arranged so that directivity axes of the microphones differ from each other or functioning as a plurality of microphones having directivities in different directions by performing a calculation on sound signals output from the plurality of microphones, detecting rotation of the plurality of microphones, processing the sound signals output from the plurality of microphones according to the detected rotation so that a change in orientation of each of the microphones is canceled, and outputting the processed output sound signals.

A sound pickup and reproduction method according to another embodiment of the present invention includes the steps of picking up sound using a plurality of microphones, the plurality of microphones being arranged so that directivity axes of the microphones differ from each other or functioning as a plurality of microphones having directivities in different directions by performing a calculation on sound signals output from the plurality of microphones, detecting rotation of the plurality of microphones, transmitting information about the detected rotation and the sound signals output from the microphones, receiving the transmitted rotation information and sound signals output from the microphones, and processing the received sound signals output from the microphones according to the received rotation information so that a change in orientation of each of the microphones is canceled.

In the multi-directional microphone system, unlike a two-channel stereo system or a binaural system, incoming sounds from different areas are picked up on an area basis.

The sound pickup method utilizes the feature of the multi-directional microphone system described above to process sound signals output from microphones according to the detected rotation of the microphones so that a change in orientation of each of the microphones is canceled, and transmits the processed output sound signals to the sound reproduction side. Thus, the confusion of a listener about auralization of the sound field in the sound reproduction side, which is caused by a change in orientation of the microphones during sound pickup, can be suppressed.

The sound pickup and reproduction method also utilizes the feature of the multi-directional microphone system described above to transmit sound signals output from microphones and rotation information about the detected rotation of the microphones to the sound reproduction side. In the sound reproduction side, the sound signals output from the microphones are processed according to the rotation information so that a change in orientation of each of the microphones in the sound pickup side is canceled. Thus, the confusion of a listener about auralization of the sound field in the sound reproduction side, which is caused by a change in orientation of the microphones during sound pickup, can be suppressed.

Therefore, when sound picked up using a multi-directional microphone system is transmitted to the sound reproduction side and the sound is reproduced using loudspeakers or a headphone in the sound reproduction side, the confusion of a listener about auralization of the sound field, which is caused by a change in orientation of the microphones during sound pickup, can be suppressed in the sound reproduction side.

DESCRIPTION OF THE PREFERRED EMBODIMENTS

First Embodiment

Figure 1:
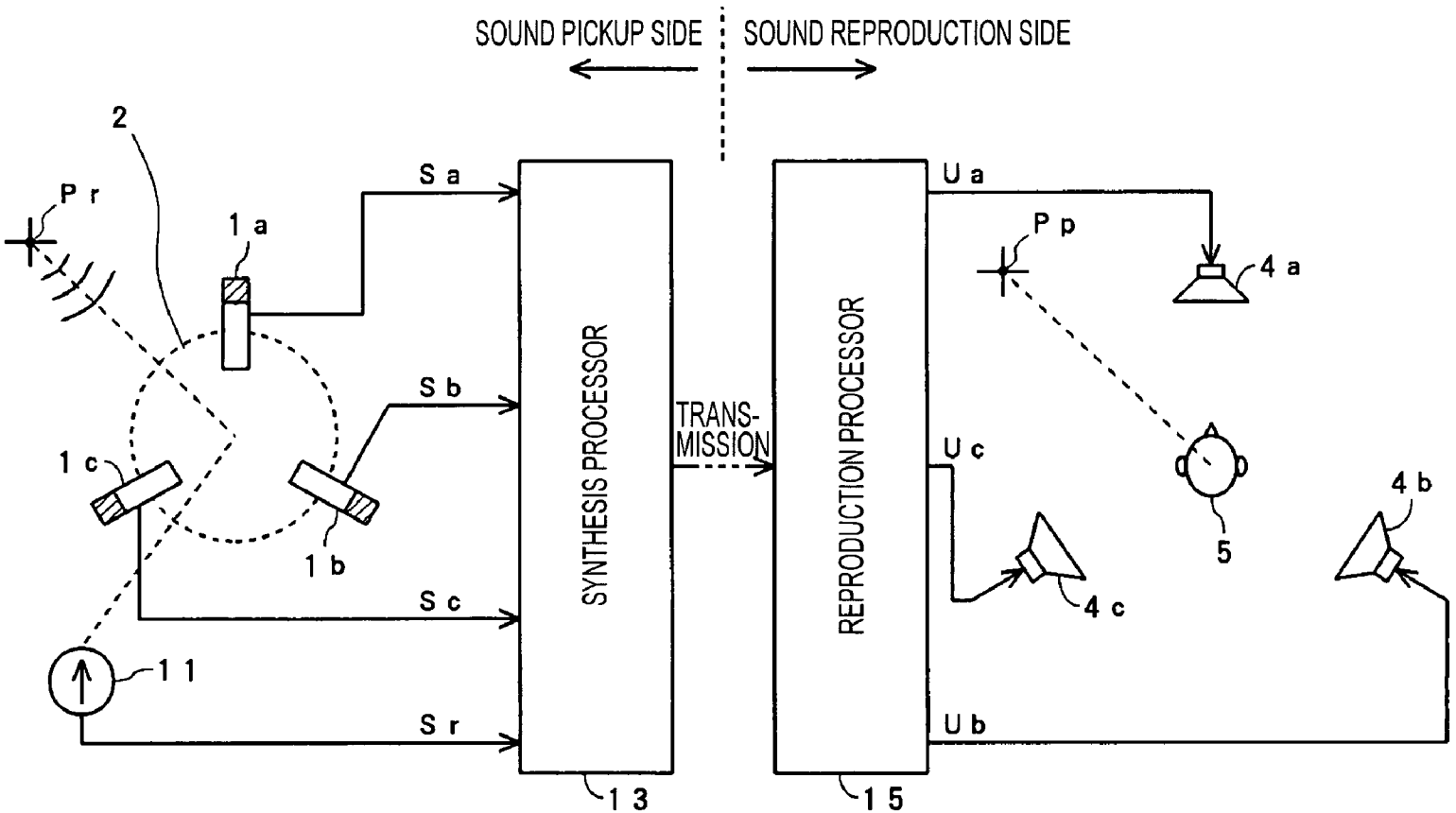
FIG. 1 is a diagram of a sound pickup and reproduction system according to an embodiment of the present invention.

FIG. 1 shows a sound pickup and reproduction system according to a first embodiment of the present invention.

The sound pickup and reproduction system shown in FIG. 1 includes a multi-microphone device 2 having three microphones 1*a*, 1*b*, and 1*c* in the sound pickup side, and three loudspeakers 4*a*, 4*b*, and 4*c* in the sound reproduction side. The loudspeakers 4*a*, 4*b*, and 4*c* are placed around a listener 5 in a similar fashion to that of the microphones 1*a*, 1*b*, and 1*c* in the sound pickup side so that the loudspeakers 4*a*, 4*b*, and 4*c* are directed to the listener 5.

Specifically, the microphones 1*a*, 1*b*, and 1*c* are unidirectional or omni-directional microphones, and are arranged radially with intervals of 120 degrees off-axis. The loudspeakers 4*a*, 4*b*, and 4*c* are also arranged with intervals of 120 degrees around the listener 5.

A synthesis processor 13 converts output sound signals Sa, Sb, and Sc from the microphones 1*a*, 1*b*, and 1*c* into digital sound signals, which are then subjected to digital signal processing, and transmits the resulting signals to the sound reproduction side. In the sound reproduction side, the digital sound signals are subjected to digital signal processing by a reproduction processor 15, and are then converted into analog sound signals Ua, Ub, and Uc. The analog sound signals Ua, Ub, and Uc are supplied to the loudspeakers 4*a*, 4*b*, and 4*c*.

The output sound signals Sa, Sb, and Sc may be transmitted by, for example, exchanging them in real-time wirelessly or via lines or by recording them onto a recording medium and reading them from the recording medium. The listener 5 may be identical to or different from a user carrying out recording.

The sound pickup and reproduction system shown in FIG. 1 further includes a rotation detector 11 for detecting rotation of the multi-microphone device 2.

The rotation detector 11 is, for example, a rotation angular speed sensor. The rotation detector 11 calculates the integral of the output signal from the rotation detector 11 to determine a rotation angle of the multi-microphone device 2, or the microphones 1*a*, 1*b*, and 1*c*, and adds the rotation angle to the initial azimuth, thereby determining the azimuth of the multi-microphone device 2, or the microphones 1*a*, 1*b*, and 1*c*.

Alternatively, the rotation detector 11 may be a geomagnetic sensor or a gravity sensor. In this case, the rotation detector 11 can directly determine the azimuth of the multi-microphone apparatus 2, or the microphones 1*a*, 1*b*, and 1*c*.

In the sound pickup and reproduction system shown in FIG. 1, the synthesis processor 13 in the sound pickup side adds rotation information Sr from the rotation detector 11 to the output sound signals Sa, Sb, and Sc from the microphones 1*a*, 1*b*, and 1*c*. Based on the rotation information Sr, the synthesis processor 13 in the sound pickup side or the reproduction processor 15 in the sound reproduction side processes the output sound signals Sa, Sb, and Sc from the microphones 1*a*, 1*b*, and 1*c* so that a change in orientation of the microphones 1*a*, 1*b*, and 1*c* is canceled.

Figure 2:
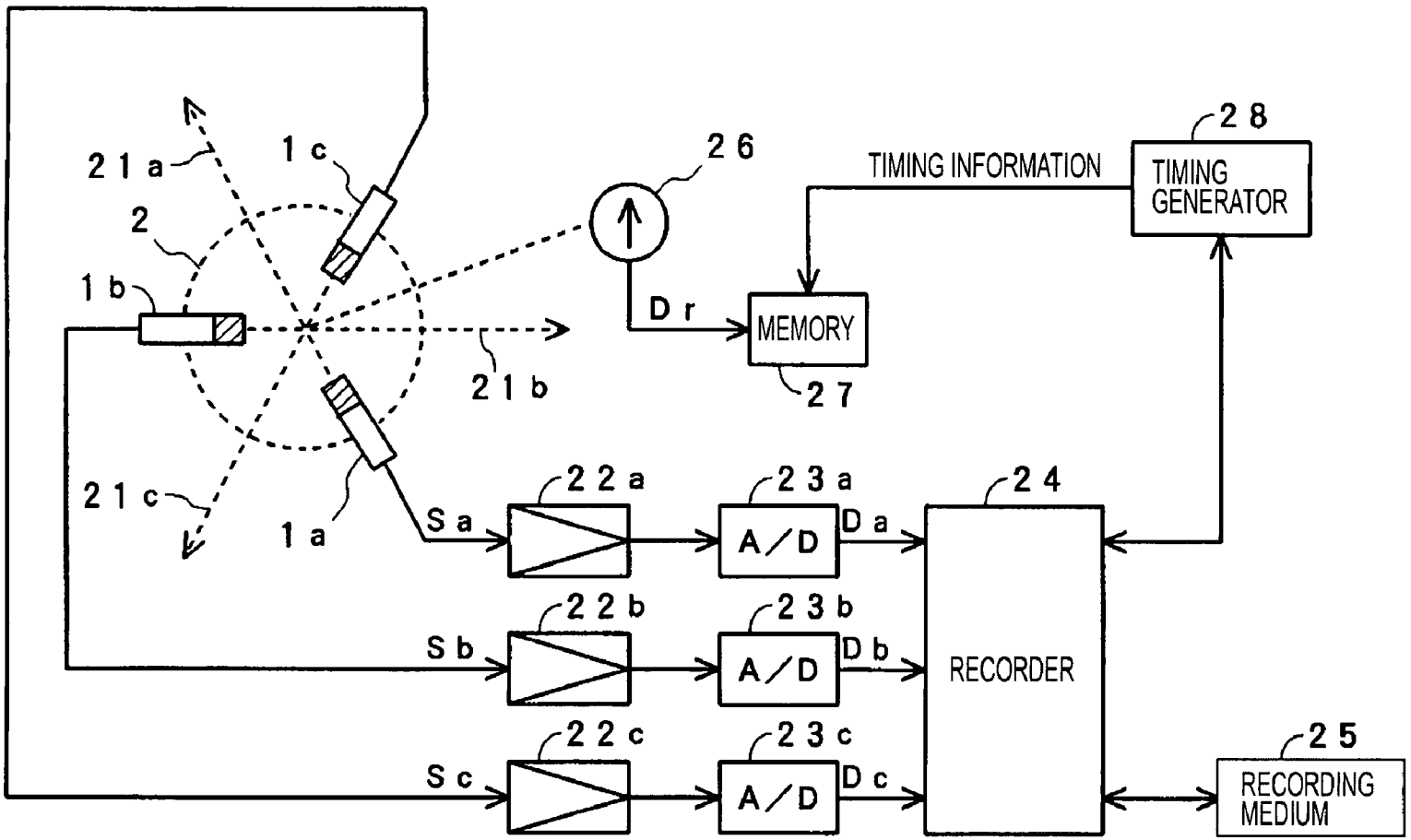
FIG. 2 is a diagram of a sound pickup apparatus according to an embodiment of the present invention.

FIG. 2 shows a sound pickup apparatus (in the sound pickup side) according to the first embodiment.

In the sound pickup apparatus shown in FIG. 2, the microphones 1*a*, 1*b*, and 1*c* are directional microphones having directivity axes 21*a*, 21*b*, and 21*c* with intervals of 120 degrees. The orientation of a gyro 26 is changed along with the multi-microphone device 2.

Output sound signals Sa, Sb, and Sc from the microphones 1*a*, 1*b*, and 1*c* are amplified by sound amplification circuits 22*a*, 22*b*, and 22*c*, and are then converted into digital sound data Da, Db, and Dc by analog-to-digital (A/D) converters 23*a*, 23*b*, and 23*c*, respectively.

The digital sound data Da, Db, and Dc are recorded in a recording medium 25, e.g., a disc medium, by a recorder 24.

Output data Dr from the gyro 26 indicating the azimuth of the microphones 1*a*, 1*b*, and 1 is recorded in a memory 27.

In order to associate the sound data Da, Db, and Dc recorded in the recording medium 25 with the azimuth data Dr recorded in the memory 27, the recorder 24 is controlled by timing information from a timing generator 28 to record the sound data Da, Db, and Dc in the recording medium 25. The timing information from the timing generator 28 is recorded in the memory 27 together with the azimuth data Dr.

The timing information may be formed of various time codes obtained by the recorder 24 or various synchronization signals.

An empty track on the recording medium 25 may be used as the memory 27. The recording medium 25 and the memory 27 may integrally be formed by a single hard disk.

Figure 3:
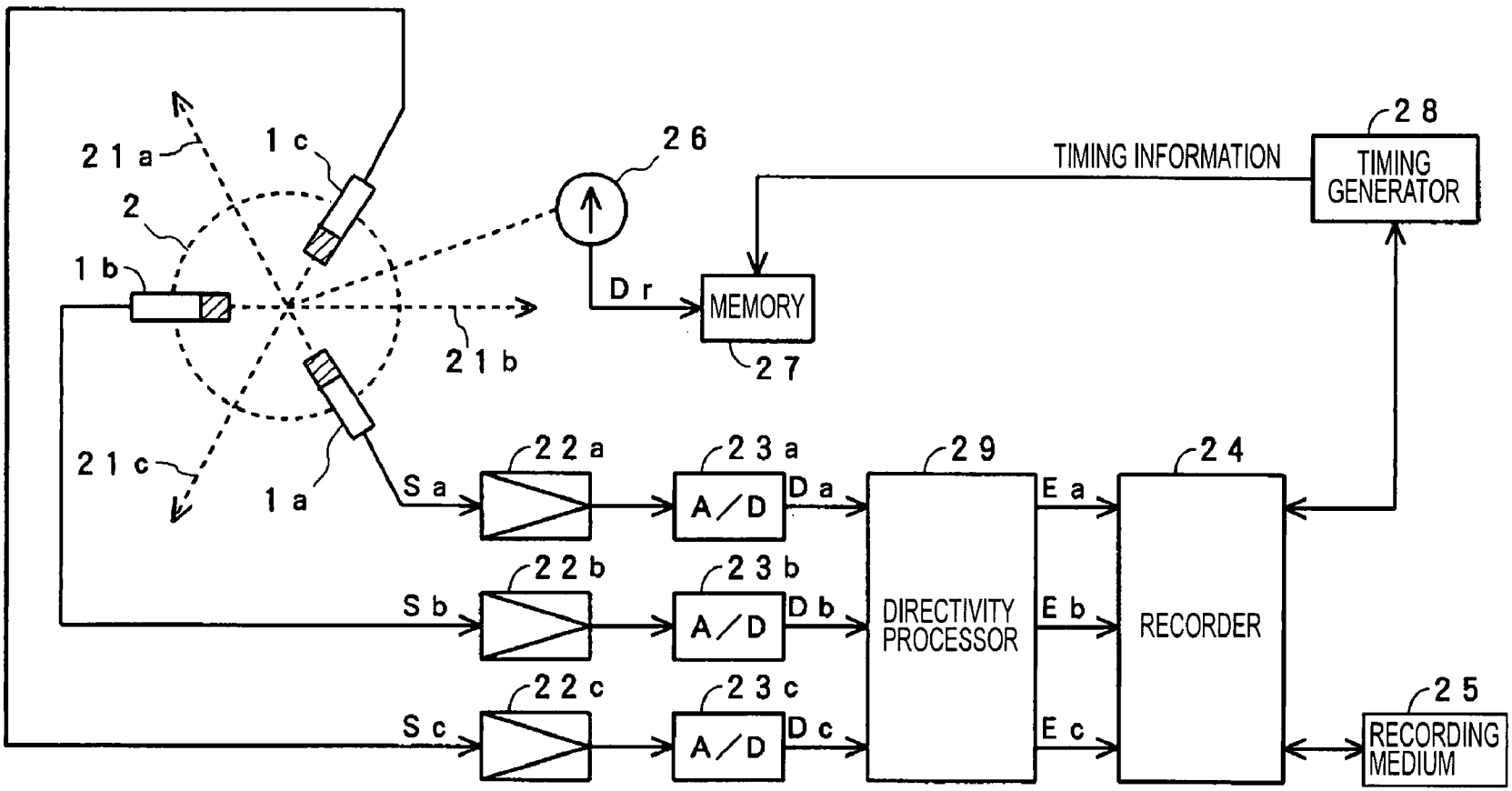
FIG. 3 is a diagram of a sound pickup apparatus according to an embodiment of the present invention.

If the microphones 1*a*, 1*b*, and 1*c* have insufficient directional characteristics or if omni-directional microphones are used as the microphones 1*a*, 1*b*, and 1*c*, as shown in FIG. 3, a processor for enhancing the directional characteristics or producing a directional characteristic is provided.

In FIG. 3, the output sound data Da, Db, and Dc from the A/D converters 23*a*, 23*b*, and 23*c* are input to a directivity processor 29, and sound data Ea, Eb, and Ec output from the directivity processor 29 are recorded in the recording medium 25 by the recorder 24.

For example, the directivity processor 29 performs calculations given by the equations below to determine the sound data Ea, Eb, and Ec:

$$Ea=Db+Dc-Da \quad \text{Eq. 1(a)}$$

$$Eb=Da+Dc-Db \quad \text{Eq. 1(b)}$$

$$Ec=Da+Db-Dc \quad \text{Eq. 1(c)}$$

Figure 4:
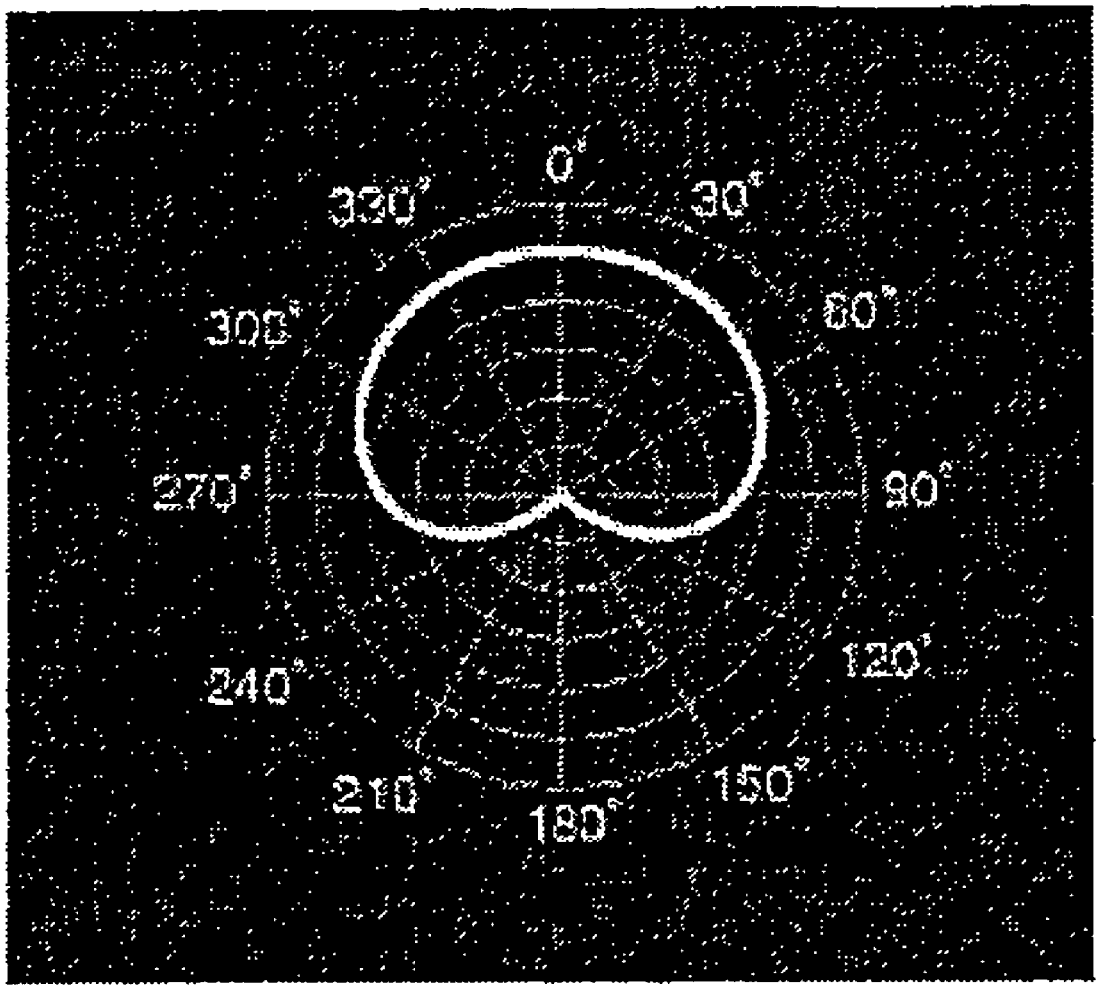
FIG. 4 is a directional characteristic of a microphone.
Figure 5:
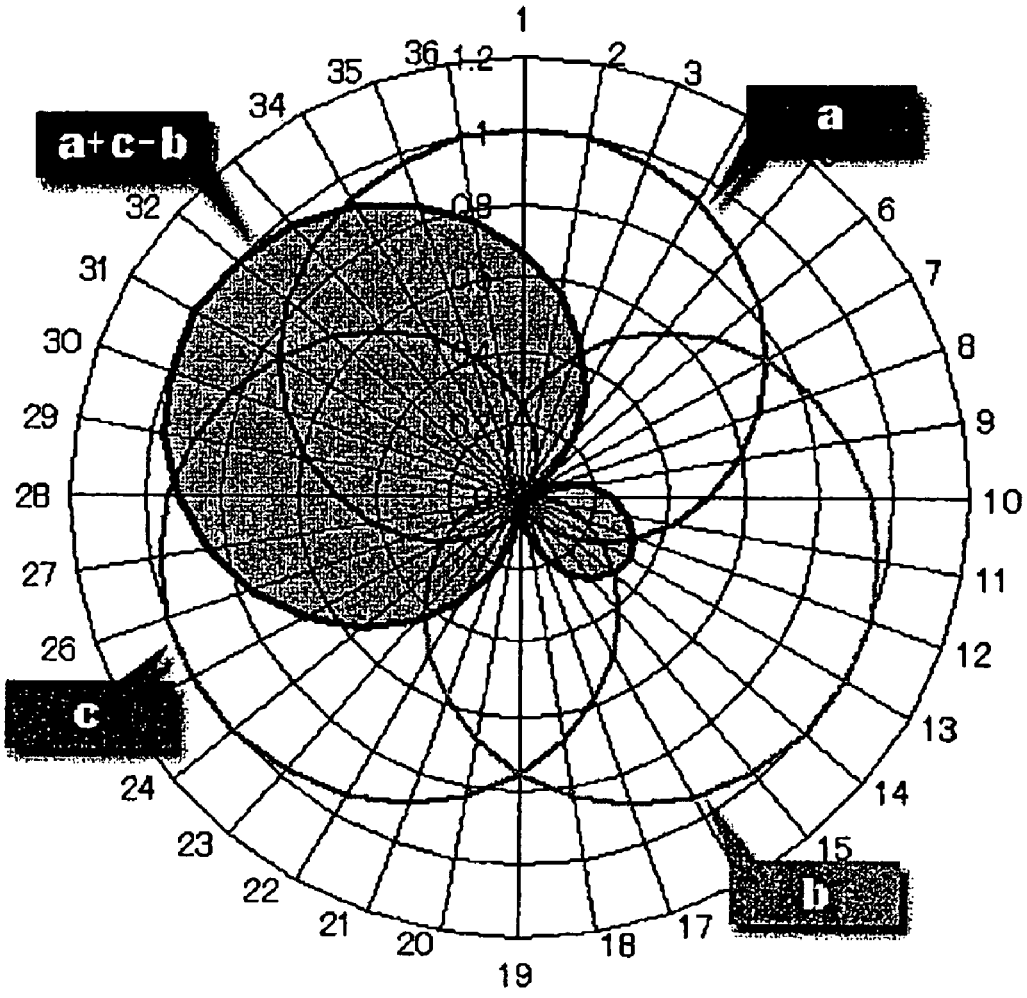
FIG. 5 is a directional characteristic of a microphone.

The calculation given by Eq. 1(b) allows, for example, a unidirectional (cardioid) microphone having a directional characteristic pattern shown in FIG. 4 to have directional characteristics stronger than the unidirectional characteristic, i.e., hyper-cardioid characteristics, indicated by a directional characteristic pattern (a+c−b) shown in FIG. 5, thus providing improved directional selectivity.

This directional processing may be performed after the unprocessed sound data Da, Db, and Dc are recorded in the recording medium 25 and read from the recording medium 25.

Figure 6:
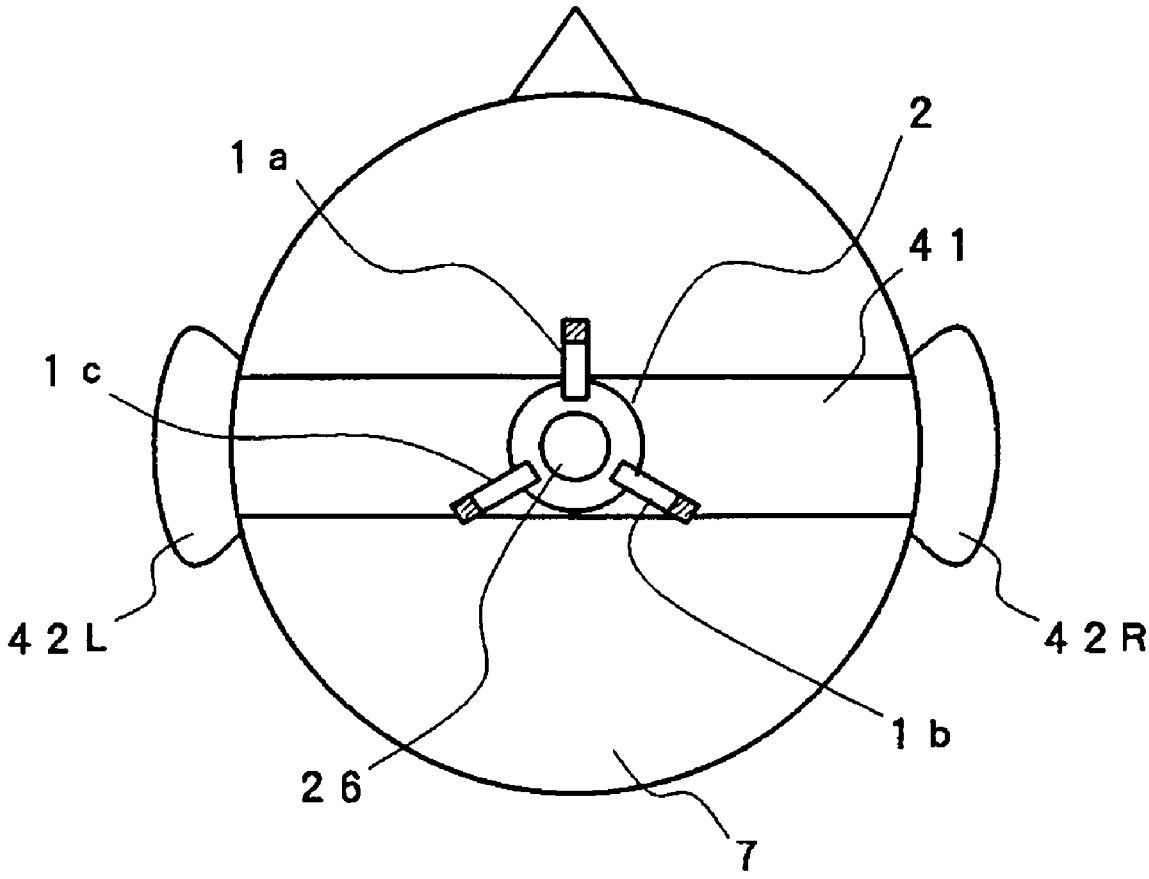
FIG. 6 is a diagram of a multi-microphone device.

FIG. 6 shows the multi-microphone device 2. In FIG. 6, the multi-microphone device 2 having a combination of the microphones 1*a*, 1*b*, and 1 is mounted on a headband 41 of a microphone attachment. The microphone attachment includes the headband 41 and right and left earpieces 42R and 42L. The gyro 26 is mounted at the center of the multi-microphone device 2.

During sound pickup, if a recording operator 7 changes his/her head orientation by looking around, the multi-microphone microphone device 2 and the gyro 26 rotate to cause a change in orientation of the microphones 1*a*, 1*b*, and 1*c*. The change of orientation is detected by the gyro 26.

Figure 7:
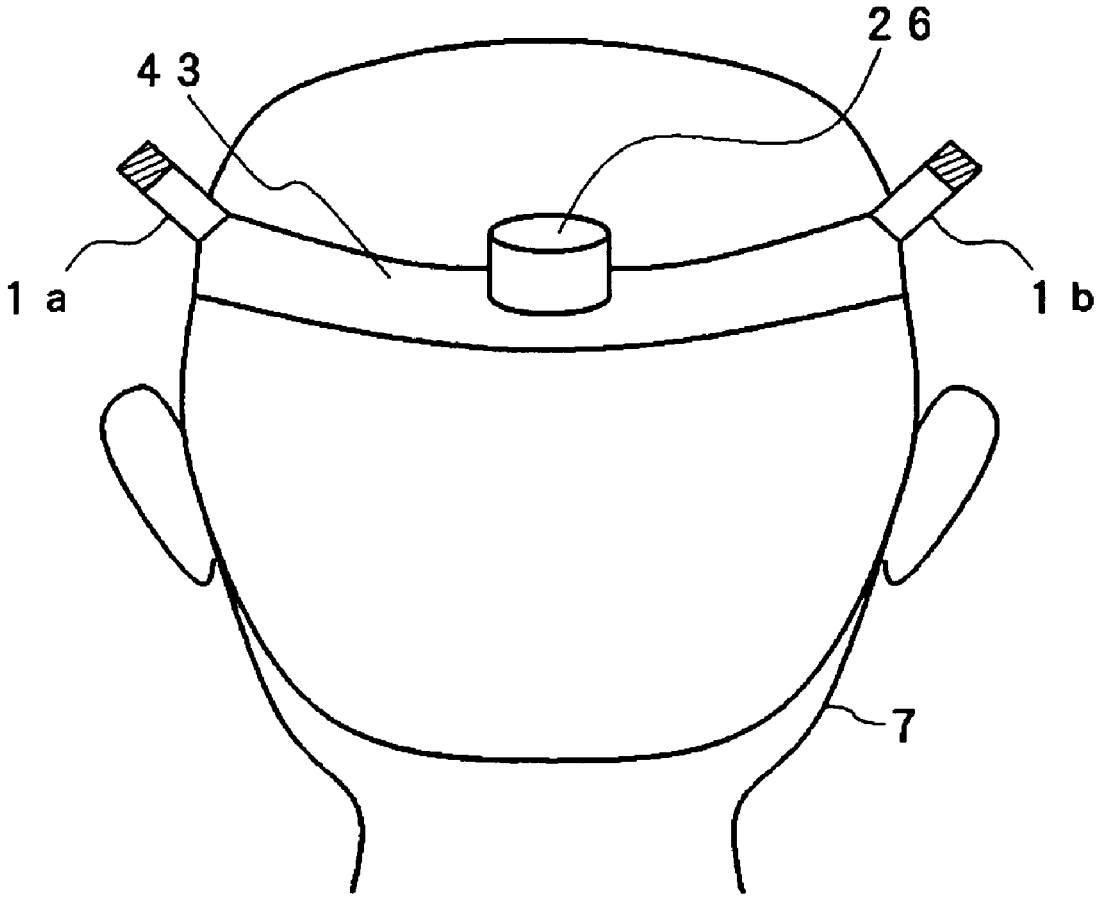
FIG. 7 is a diagram of another multi-microphone device.

The multi-microphone device 2 may have a configuration shown in FIG. 7, in which the microphones 1*a*, 1*b*, and 1*c* and the gyro 26 are directly mounted on a band-shaped microphone attachment 43.

Figure 8:
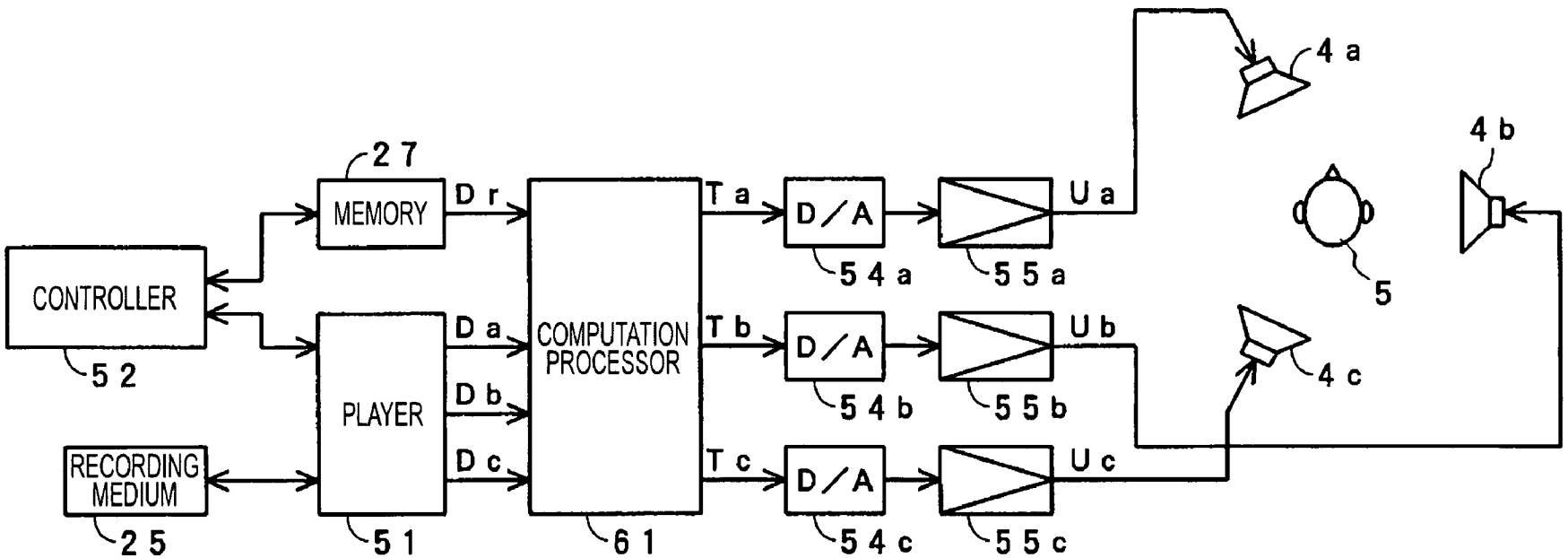
FIG. 8 is a block diagram of a sound reproduction apparatus according to an embodiment of the present invention.

FIG. 8 shows a sound reproduction apparatus (in the sound reproduction side) according to the first embodiment. The sound reproduction apparatus corresponding to the sound pickup apparatus shown in FIG. 2 or 3 cancels, in the sound reproduction side, a change in orientation of the microphones 1*a*, 1*b*, and 1*c* in the sound pickup side, and reproduces sound using loudspeakers 4*a*, 4*b*, and 4*c*.

In the sound reproduction apparatus shown in FIG. 8, a player 51 retrieves the sound data Da, Db, and Dc recorded in the manner described above (or the sound data Ea, Eb, and Ec if the sound data Da, Db, and Dc are processed by the directivity processor 29 shown in FIG. 3) from the recording medium 25, and supplies the read data to a computation processor 61. The azimuth data Dr recorded in the manner described above is read from the memory 27 by a controller 52, and is also supplied to the computation processor 61.

The retrieval of the sound data Da, Db, and Dc from the recording medium 25 and the reading of the azimuth data Dr from the memory 27 are controlled by the controller 52 based on the timing information recorded in the memory 27 so that the retrieval of the sound data Da, Db, and Dc from the recording medium 25 and the reading of the azimuth data Dr from the memory 27 are performed at the same timing as those in the sound pickup processing.

The computation processor 61 performs processing so that the sound data Da, Db, and Dc cancel a change in orientation of the microphones 1*a*, 1*b*, and 1*c* in the sound pickup side based on the azimuth data Dr in the manner described below.

Processed sound data Ta, Tb, and Tc are converted into analog sound signals by digital-to-analog (D/A) converters 54*a*, 54*b*, and 54*c*, and the converted three-channel sound signals are amplified by sound amplification circuits 55*a*, 55*b*, and 55*c*, respectively. The amplified sound signals Ua, Ub, and Uc are supplied to the loudspeakers 4*a*, 4*b*, and 4*c*, respectively.

The loudspeakers 4*a*, 4*b*, and 4*c* are arranged with intervals of 120 degrees around the listener 5 in a similar fashion to the arrangement of the main directivity axes of the microphones 1*a*, 1*b*, and 1*c* in the sound pickup apparatus shown in FIG. 2 or 3 so that the loudspeakers 4*a*, 4*b*, and 4*c* are directed to the listener 5.

Figure 9:
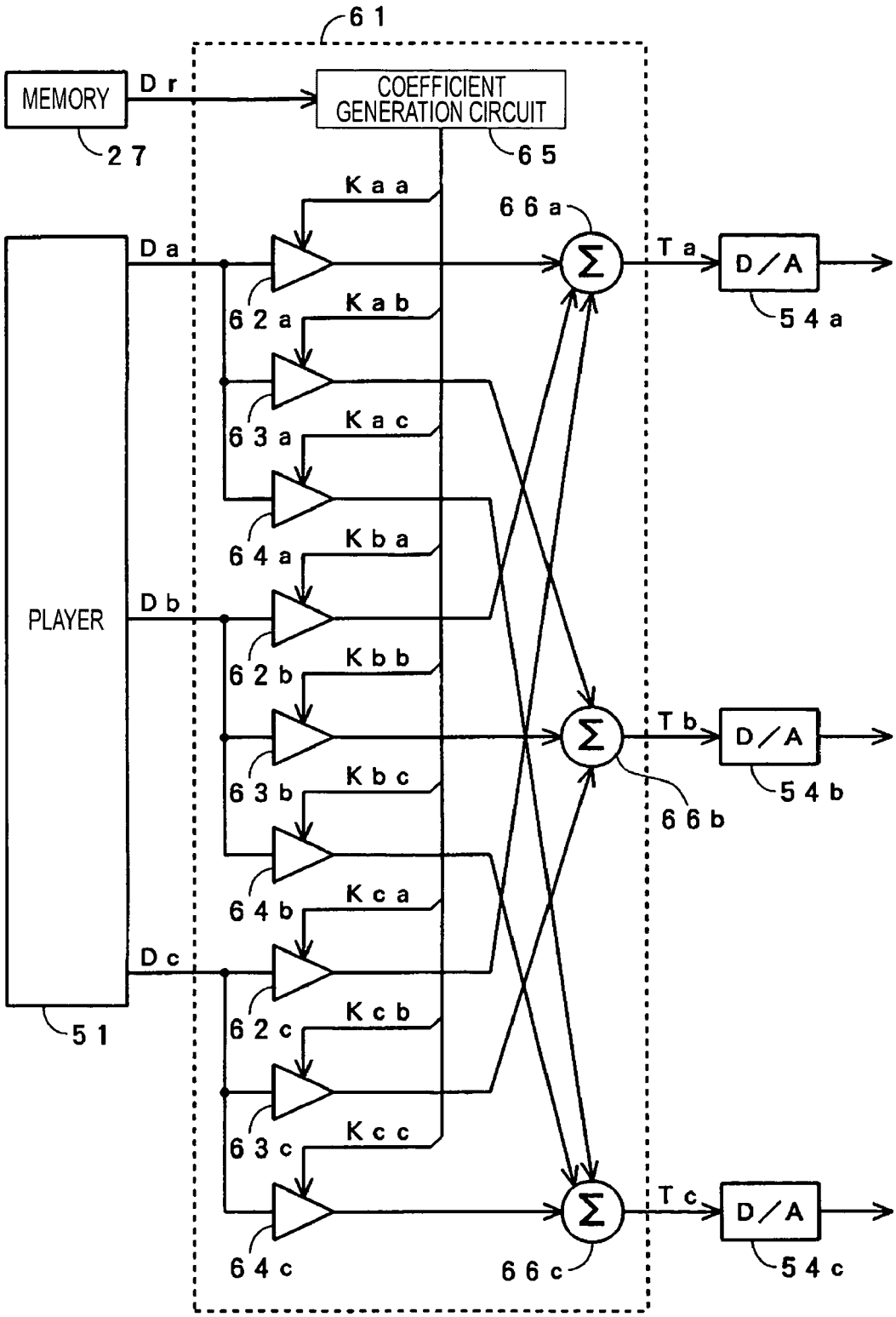
FIG. 9 is a block diagram of a computation processor in the sound reproduction apparatus shown in FIG. 8.

FIG. 9 shows the computation processor 61. In the computation processor 61 shown in FIG. 9, the sound data Da is supplied to multiplication circuits 62*a*, 63*a*, and 64*a*, the sound data Db is supplied to multiplication circuits 62*b*, 63*b*, and 64*b*, and the sound data Dc is supplied to multiplication circuits 62*c*, 63*c*, and 64*c*. The azimuth data Dr is supplied to a coefficient generation circuit 65. The coefficient generation circuit 65 generates and updates coefficients Kaa, Kab, Kac, Kba, Kbb, Kbc, Kca, Kcb, and Kcc depending upon the value of the azimuth data Dr, and supplies the coefficients Kaa, Kab, Kac, Kba, Kbb, Kbc, Kca, Kcb, and Kcc to the multiplication circuits 62*a*, 63*a*, 64*a*, 62*b*, 63*b*, 64*b*, 62*c*, 63*c*, and 64*c*, respectively.

Adder circuits 66*a*, 66*b*, and 66*c* calculate additions given by the equations below to determine the processed sound data Ta, Tb, and Tc:

$$Ta=Kaa\times Da+Kba\times Db+Kca\times Dc \quad \text{Eq. 2(a)}$$

$$Tb=Kab\times Da+Kbb\times Db+Kcb\times Dc \quad \text{Eq. 2(b)}$$

$$Tc=Kac\times Da+Kbc\times Db+Kcc\times Dc \quad \text{Eq. 2(c)}$$

The coefficient generation circuit 65 changes the values of the coefficients Kaa, Kab, Kac, Kba, Kbb, Kbc, Kca, Kcb, and Kcc depending upon the value of the azimuth data Dr, that is, the rotation direction and the amount of rotation (rotation angle) of the microphones 1*a*, 1*b*, and 1*c* in the sound pickup side, so that a change in orientation of the microphones 1*a*, 1*b*, and 1*c* is canceled.

Thus, the sound data that allows for cancellation of a change in orientation of the microphones 1*a*, 1*b*, and 1*c* in the sound pickup side can be obtained as the sound data Ta, Tb, and Tc. The confusion of the listener 5 about auralization of the sound field can therefore be suppressed.

As described above with reference to FIG. 1, a change in orientation of the microphones 1*a*, 1*b*, and 1*c* may be canceled in the sound pickup side. In this case, the recorder 24 shown in FIG. 2 or 3 may be provided with the computation processor 61 shown in FIG. 9. Since this cancellation processing is omitted in the sound reproduction side, it is not necessary for the sound pickup apparatus to transmit the rotation information Sr and the azimuth data Dr to the sound reproduction side.

The sound reproduction apparatus shown in FIG. 8 reproduces sound using the loudspeakers 4*a*, 4*b*, and 4*c*. The present invention is also applicable to an apparatus for sound reproduction using a headphone.

However, if sound is simply reproduced using a headphone, a sound image is localized in the listener's head, which produces an unnatural auditory sensation.

In headphone reproduction, therefore, it is desirable to perform out-of-head localization processing for localizing the sound image outside the listener's head using the so-called HRTF (Head-Related Transfer Function) technique and processing for generating a sound field that produces a sensation like the listener is surrounded by loudspeakers in the manner shown in FIG. 8.

Figure 10:
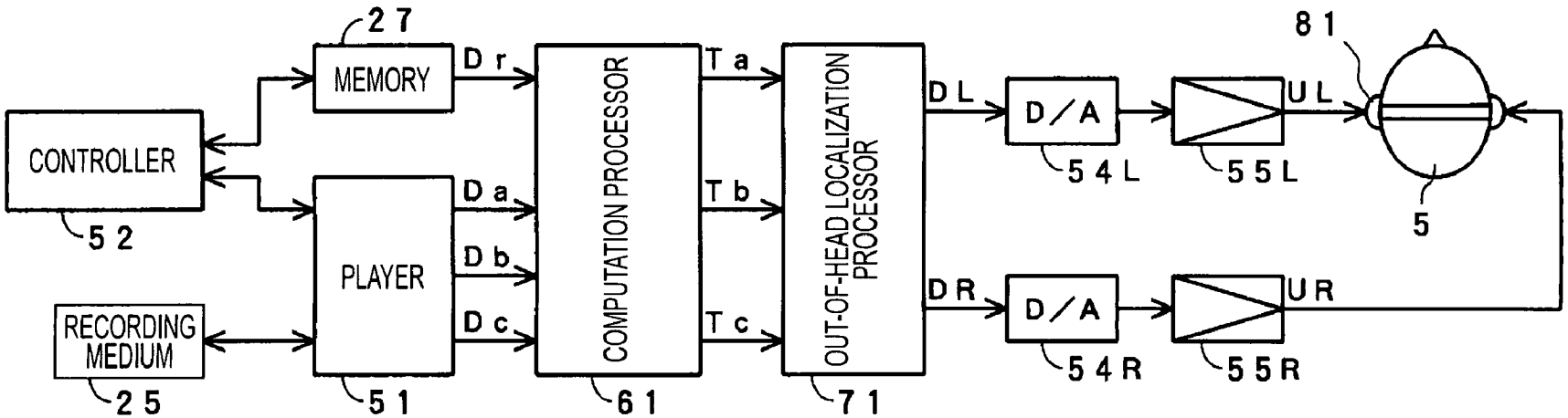
FIG. 10 is a block diagram of a sound reproduction apparatus according to an embodiment of the present invention.

FIG. 10 shows a sound reproduction apparatus (in the sound reproduction side) according to the first embodiment for reproducing sound using a headphone while performing such out-of-head localization.

In the sound reproduction apparatus shown in FIG. 10, the sound data Ta, Tb, and Tc that has been processed by the computation processor 61 in the manner described above with reference to FIG. 9 are processed by an out-of-head localization processor 71 in the manner described below. The resulting right-channel and left-channel sound data DR and DL are converted into analog sound signals by D/A converters 54R and 54L, and the converted right-channel and left-channel sound signals are amplified by sound amplification circuits 55R and 55L, respectively. The amplified signals UR and UL are supplied to right and left acoustic transducers of a headphone 81, respectively.

Figure 11:
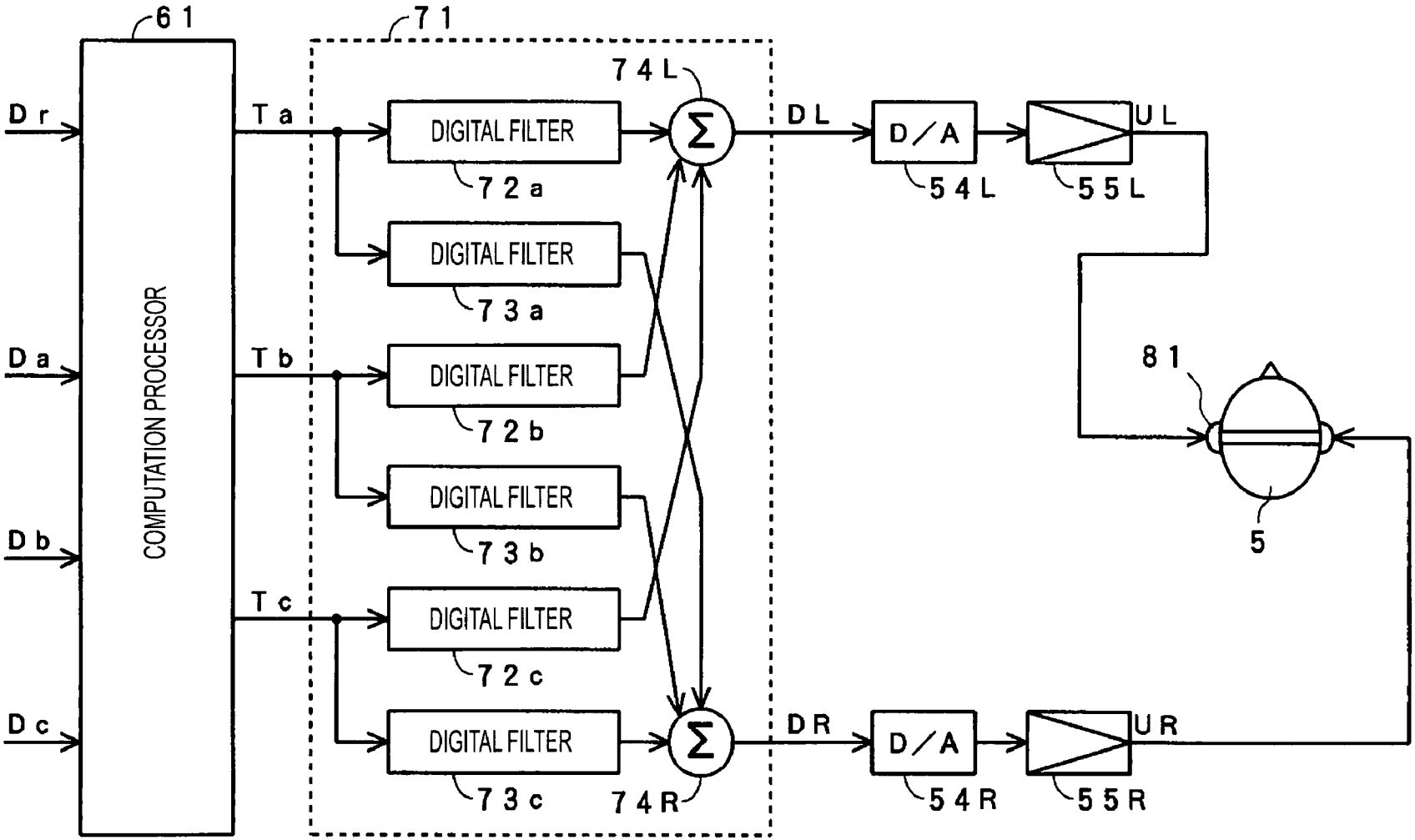
FIG. 11 is a block diagram of an out-of-head localization processor in the sound reproduction apparatus shown in FIG. 10.

FIG. 11 shows the out-of-head localization processor 71. In the out-of-head localization processor 71 shown in FIG. 11, the sound data Ta processed by the computation processor 61 is supplied to digital filters 72*a* and 73*a*, the sound data Tb processed by the computation processor 61 is supplied to digital filters 72*b* and 73*b*, and the sound data Tc processed by the computation processor 61 is supplied to digital filters 72*c* and 73*c*. The sound data output from the digital filters 72*a*, 72*b*, and 72*c* are added by an adder circuit 74L to determine out-of-head localized left-channel sound data DL. The sound data output from the digital filters 73*a*, 73*b*, and 73*c* are added by an adder circuit 74R to determine out-of-head localized right-channel sound data DR.

The digital filters 72*a*, 72*b*, and 72*c* convolve an impulse response from the position of a virtual loudspeaker at which the sound image is to be localized to the left ear of the listener 5 with the sound data Ta, Tb, and Tc, respectively. The digital filters 73*a*, 73*b*, and 73*c* convolve an impulse response from the position of a virtual loudspeaker at which the sound image is to be localized to the right ear of the listener 5 with the sound data Ta, Tb, and Tc, respectively.

Thus, even in headphone reproduction, an auditory sensation like acoustics being reproduced using loudspeakers in the manner shown in FIG. 8 can be produced.

In the sound reproduction apparatus shown in FIGS. 10 and 11, the computation processor 61 cancels a change in orientation of the microphones 1*a*, 1*b*, and 1*c* in the sound pickup side, and then the out-of-head localization processor 71 localizes the sound image outside the listener's head. The out-of-head localization processing and the processing for canceling a change in orientation of the microphones 1*a*, 1*b*, and 1*c* in the sound pickup side may be performed in parallel.

Figure 12:
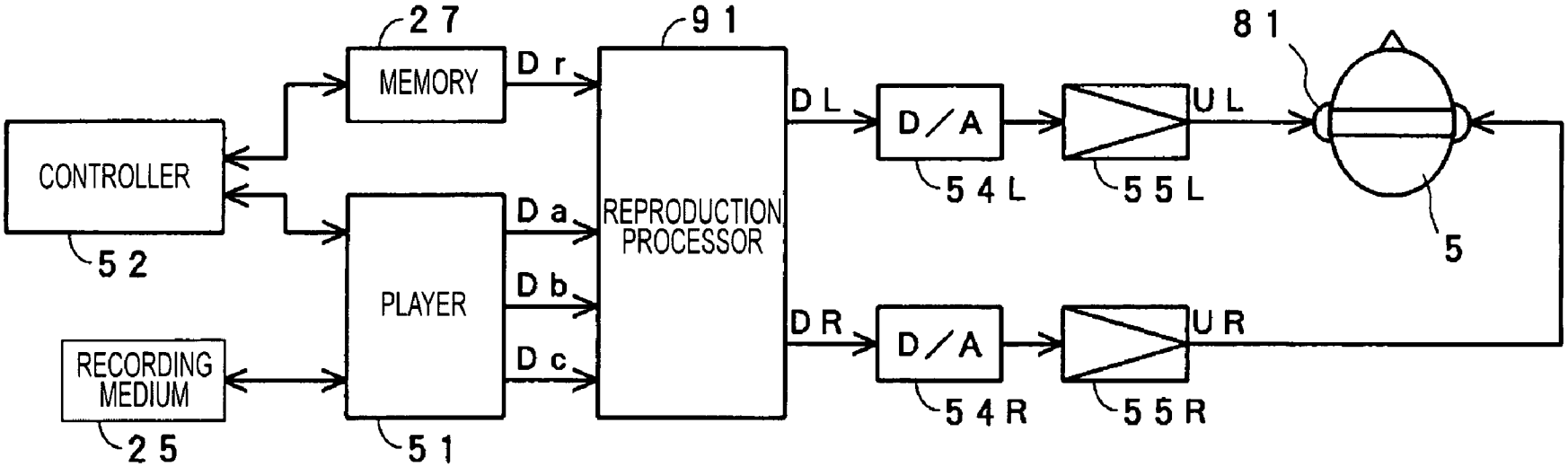
FIG. 12 is a block diagram of a sound reproduction apparatus according to an embodiment of the present invention.

FIG. 12 shows a sound reproduction apparatus (in the sound reproduction side) according to the first embodiment for performing the out-of-head localization processing and the cancellation processing in parallel. In the sound reproduction apparatus shown in FIG. 12, the sound data Da, Db, and Dc read from the recording medium 25 by the player 51 and the azimuth data Dr read from the memory 27 are supplied to a reproduction processor 91. The reproduction processor 91 performs parallel processing for localizing a sound image outside the listener's head and canceling a change in orientation of the microphones 1*a*, 1*b*, and 1*c* in the sound pickup side.

Figure 13:
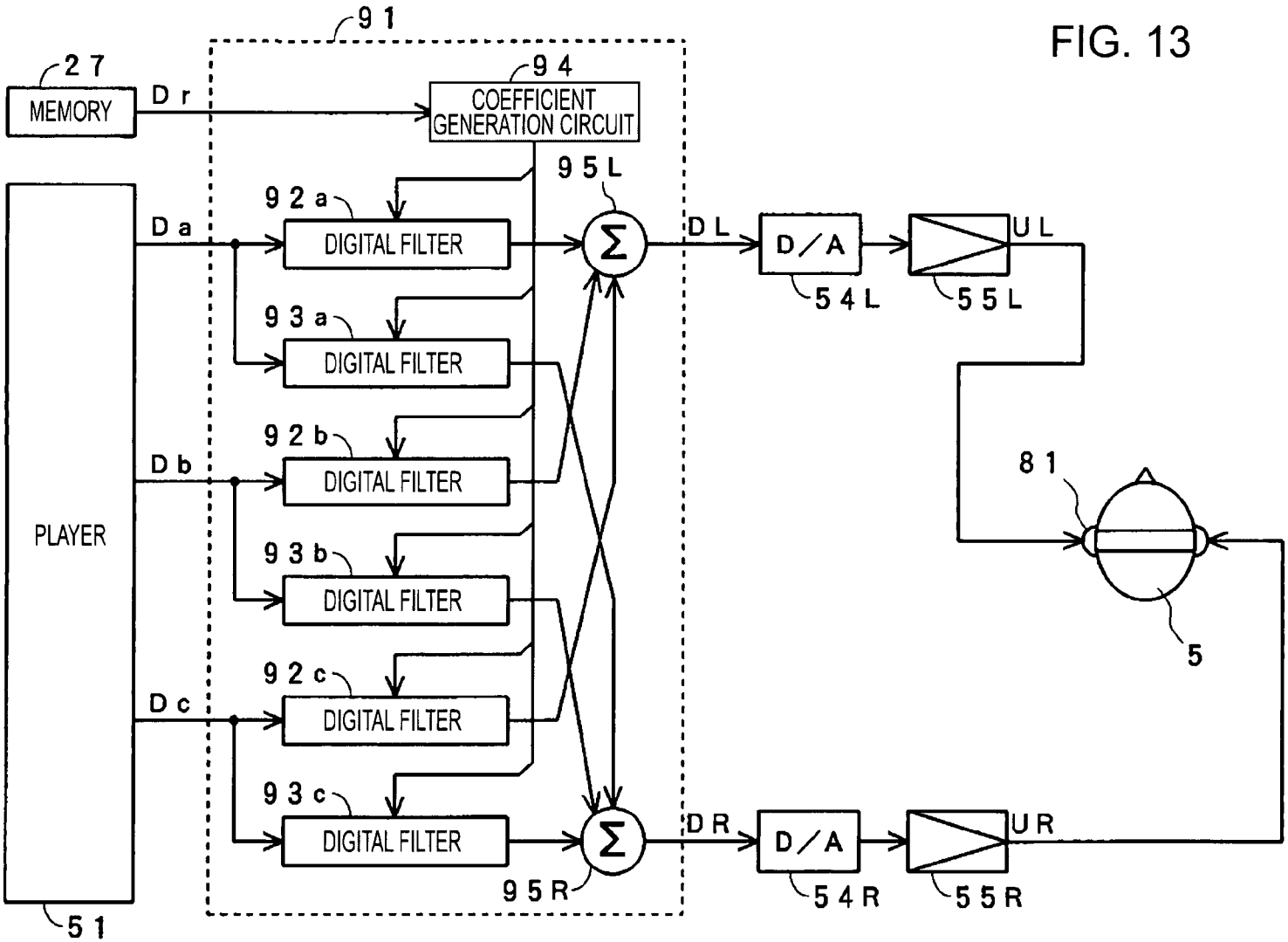
FIG. 13 is a block diagram of a reproduction processor in the sound reproduction apparatus shown in FIG. 12.

Specifically, as shown in FIG. 13, in the reproduction processor 91, the sound data Da is supplied to digital filters 92*a* and 93*a*, the sound data Db is supplied to digital filters 92*b* and 93*b*, and the sound data Dc is supplied to digital filters 92*c* and 93*c*. The azimuth data Dr is supplied to a coefficient generation circuit 94. The coefficient generation circuit 94 generates and updates coefficients of the digital filters 92*a*, 93*a*, 92*b*, 93*b*, 92*c*, and 93*c* depending upon the value of the azimuth data Dr. The sound data output from the digital filters 92*a*, 92*b*, and 92*c* are added by an adder circuit 95L to determine processed left-channel sound data DL, and the sound data output from the digital filters 93*a*, 93*b*, and 93*c* are added by an adder circuit 95R to determine processed right-channel sound data DR.

The digital filters 92*a*, 92*b*, and 92*c* convolve an impulse response from the position of a virtual loudspeaker at which the sound image is to be localized to the left ear of the listener 5 with the sound data Da, Db, and Dc, respectively. The digital filters 93*a*, 93*b*, and 93*c* convolve an impulse response from the position of a virtual loudspeaker at which the sound image is to be localized to the right ear of the listener 5 with the sound data Da, Db, and Dc, respectively. At the same time, the coefficient generation circuit 94 in the reproduction processor 91 changes the coefficients of the digital filters 92*a*, 93*a*, 92*b*, 93*b*, 92*c*, and 93*c* depending upon the value of the azimuth data Dr, that is, the rotation direction and the amount of rotation (rotation angle) of the microphones 1*a*, 1*b*, and 1*c* in the sound pickup side, so that a change in orientation of the microphones 1*a*, 1*b*, and 1*c* in the sound pickup side is canceled.

The large difference between loudspeaker reproduction and headphone reproduction is an auditory sensation produced when a listener moves his/her head to the right and left. When the listener shakes his/her head in loudspeaker reproduction, a natural auditory sensation like the listener is shaking his/her head in the recording site is produced. On the other hand, when the listener shakes his/her head in headphone reproduction, the sound field also moves, which does not produce an auditory sensation like the listener is in the recording site.

It is therefore desirable to perform headphone reproduction while performing an operation to overcome this problem.

Figure 14:
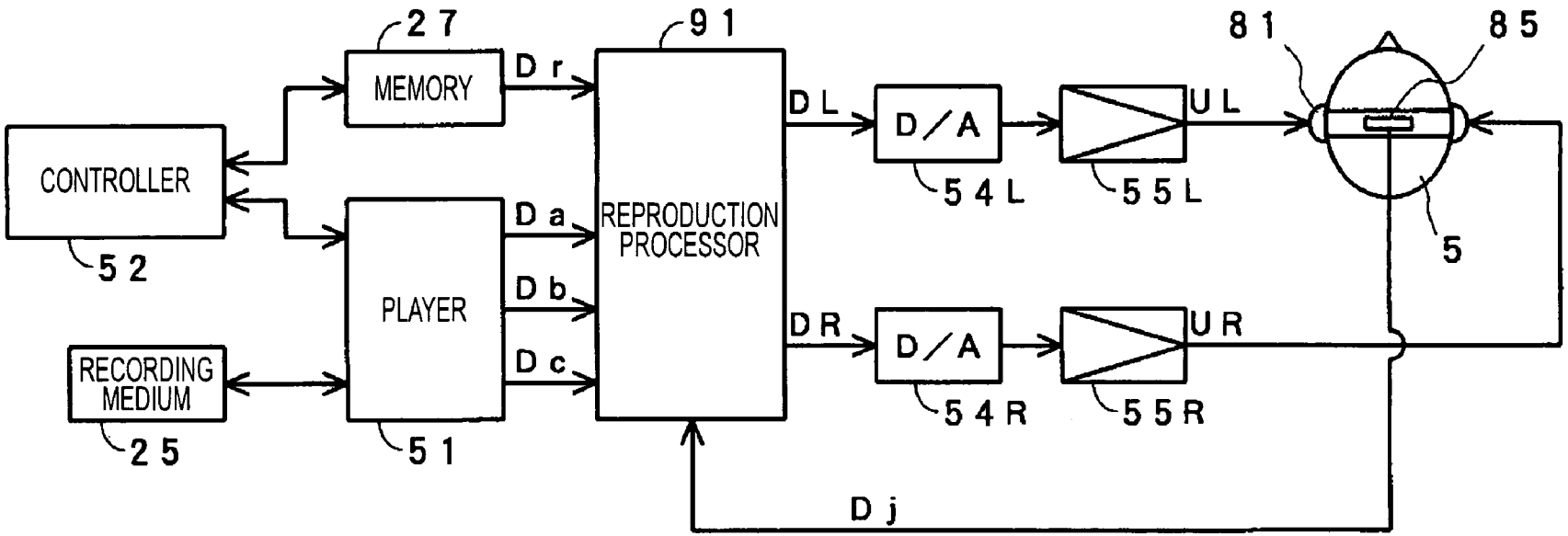
FIG. 14 is a block diagram of a sound reproduction apparatus according to an embodiment of the present invention.

FIG. 14 shows a sound reproduction apparatus (in the sound reproduction side) according to the first embodiment for reproducing sound using a headphone while performing an operation to overcome the problem described above.

The sound reproduction apparatus shown in FIG. 14 further includes a gyro 85 mounted on a headband of the headphone 81 worn by the listener 5 in the sound reproduction apparatus shown in FIG. 12 for detecting motion (head movement) of the listener 5 who moves his/her head to the right and left.

Azimuth data Dj output from the gyro 85 is supplied to the reproduction processor 91 together with the sound data Da, Db, and Dc retrieved from the recording medium 25 by the player 51 shown in FIG. 12 and the azimuth data Dr read from the memory 27. The reproduction processor 91 performs parallel processing for localizing a sound image outside the listener's head, canceling a change in orientation of the microphones 1*a*, 1*b*, and 1*c* in the sound pickup side, and preventing the sound field from moving along with head movement when the listener 5 moves his/her head to the right and left.

Figure 15:
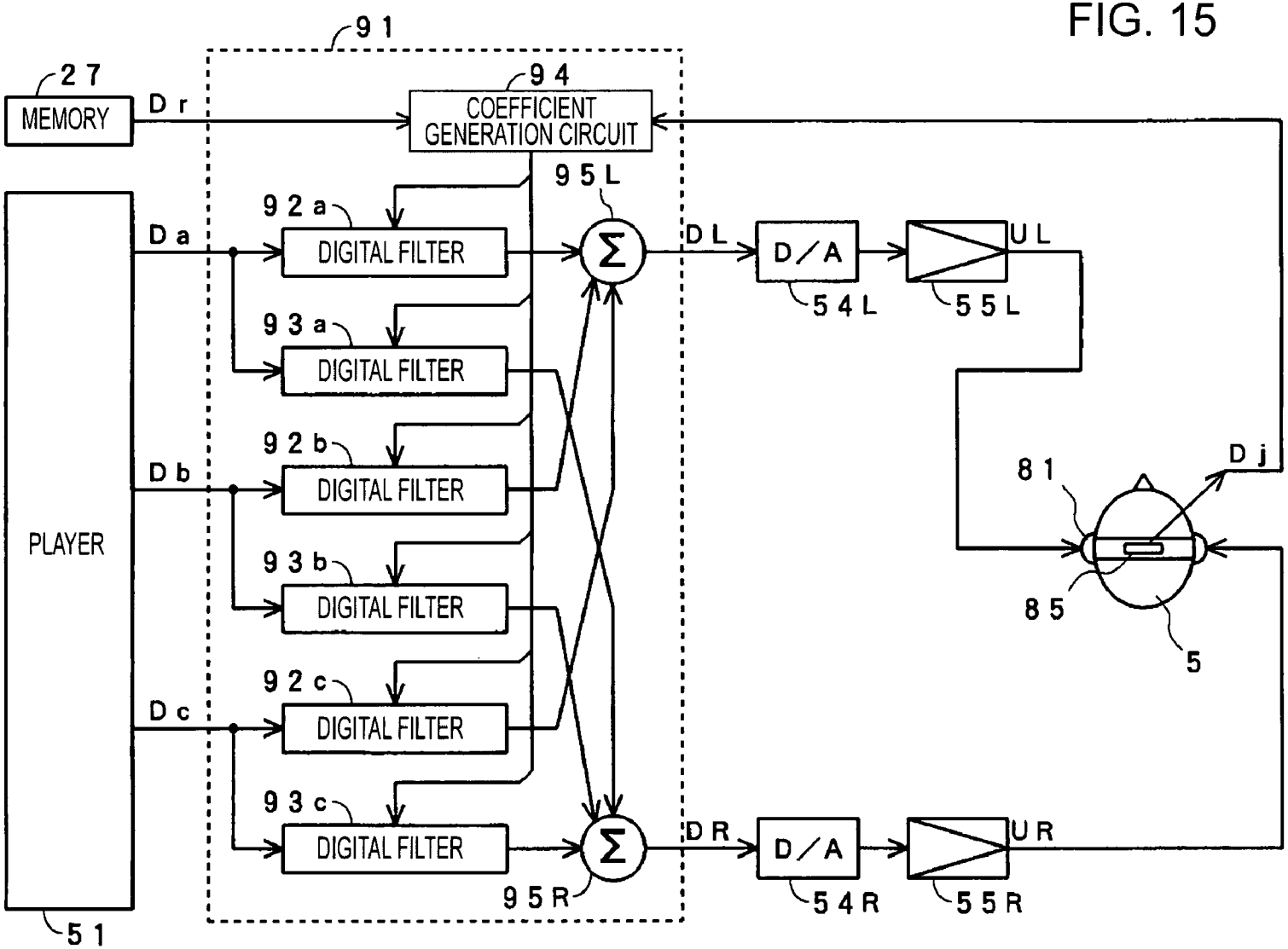
FIG. 15 is a block diagram of a reproduction processor in the sound reproduction apparatus shown in FIG. 14.

Specifically, as shown in FIG. 15, in the reproduction processor 91, the sound data Da is supplied to digital filters 92*a* and 93*a*, the sound data Db is supplied to digital filters 92*b* and 93*b*, and the sound data Dc is supplied to digital filters 92*c* and 93*c*. The azimuth data Dr and Dj are supplied to the coefficient generation circuit 94. The coefficient generation circuit 94 generates and updates the coefficients of the digital filters 92*a*, 93*a*, 92*b*, 93*b*, 92*c*, and 93*c* depending upon the values of the azimuth data Dr and Dj. The sound data output from the digital filters 92*a*, 92*b*, and 92*c* are added by the adder circuit 95L to determine processed left-channel sound data DL, and the sound data output from the digital filters 93*a*, 93*b*, and 93*c* are added by the adder circuit 95R to determine processed right-channel sound data DR.

The digital filters 92*a*, 92*b*, and 92*c* convolve an impulse response from the position of a virtual loudspeaker at which the sound image is to be localized to the left ear of the listener 5 with the sound data Da, Db, and Dc, respectively. The digital filters 93*a*, 93*b*, and 93*c* convolve an impulse response from the position of a virtual loudspeaker at which the sound image is to be localized to the right ear of the listener 5 with the sound data Da, Db, and Dc, respectively. At this time, the coefficient generation circuit 94 in the reproduction processor 91 changes the coefficients of the digital filters 92*a*, 93*a*, 92*b*, 93*b*, 92*c*, and 93*c* depending upon the values of the azimuth data Dr and Dj, that is, the rotation direction and the amount of rotation (rotation angle) of the microphones 1*a*, 1*b*, and 1*c* in the sound pickup side and the direction and the amount of head movement (rotation angle) of the listener 5 in the sound reproduction side, so that both a change in orientation of the microphones 1*a*, 1*b*, and 1*c* in the sound pickup side and a movement of the sound field caused by head movement of the listener 5 in the sound reproduction side are canceled.

Therefore, the confusion of the listener 5 about auralization of the sound field in the sound reproduction side, which is caused by a change in orientation of the microphones 1*a*, 1*b*, and 1*c* in the sound pickup side, can be suppressed. Moreover, the sound field can also be prevented from moving along with head movement when the listener 5 shakes his/her head, which thus produces a natural auditory sensation like the listener 5 is shaking his/her head in the recording site, like loudspeaker reproduction.

Second Embodiment

In the first embodiment, the multi-microphone device 2 mounted on the head of the recording operator 7 rotates when the recording operator 7 changes the orientation of his/her head during sound pickup to cause a change in orientation of the microphones 1*a*, 1*b*, and 1*c*. In some cases, the recording operator 7 changes not only the orientation of his/her head but also the orientation of his/her body itself during sound pickup, for example, when the recording operator 7 turns to the right or left on a street during sound pickup and when the recording operator 7 rides on a vehicle, such as a roller coaster, and the vehicle turns during sound pickup.

In such cases, acoustic surroundings to be recorded change, and environmental views or landscape views to be taken using a video camera also change at the same time. In such cases, it is desirable not to cancel a change in orientation of the microphones 1*a*, 1*b*, and 1*c*.

A case in which a change in orientation of microphones caused by a rotation of the operator's body is not canceled will be described with reference to FIG. 16.

Figure 16:
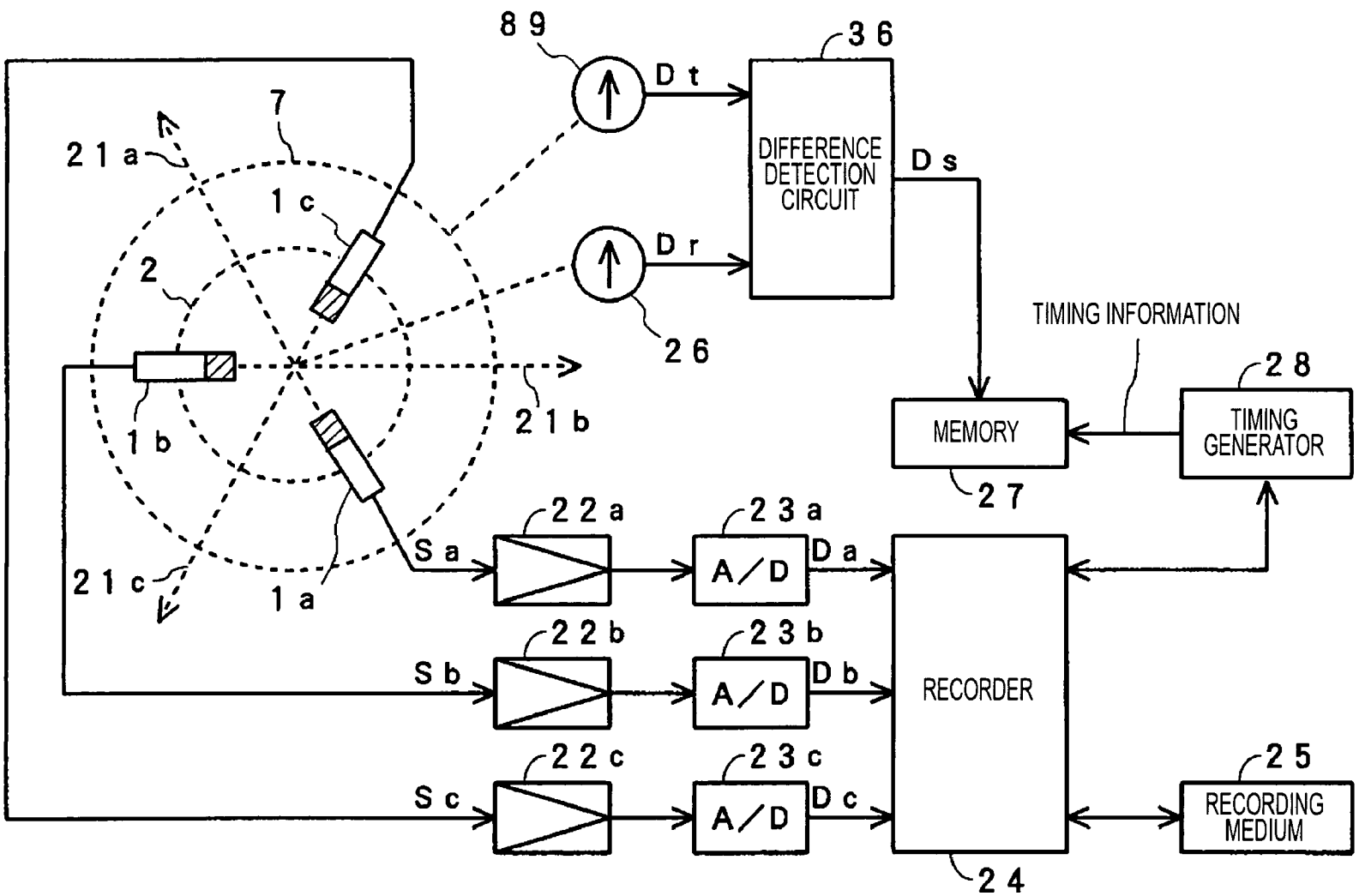
FIG. 16 is a block diagram of a sound pickup apparatus according to an embodiment of the present invention.

FIG. 16 shows a sound pickup apparatus (in the sound pickup side) according to a second embodiment of the present invention in which such a change is not canceled. In the sound pickup apparatus shown in FIG. 16, a multi-microphone device 2 integrally incorporating three microphones 1*a*, 1*b*, and 1*c* is mounted on the head of a recording operator 7 in the manner shown in FIG. 6 or 7. A gyro 26 is mounted on the multi-microphone device 2 in the manner shown in FIG. 6 or 7 for detecting rotation of the multi-microphone device 2, and a gyro 89 is further mounted on, for example, the back of the recording operator 7 for detecting rotation of the body of the recording operator 7.

Azimuth data Dt output from the gyro 89 and azimuth data Dr output from the gyro 26 are supplied to a difference detection circuit 36, and the difference detection circuit 36 determines difference data Ds between the azimuth data Dt and Dr.

The difference data Ds indicates the rotation direction and the amount of rotation (rotation angle) of the head of the recording operator 7 on which the multi-microphone device 2 and the gyro 26 are mounted with respect to the body of the recording operator 7 on which the gyro 89 is mounted.

Figure 17:
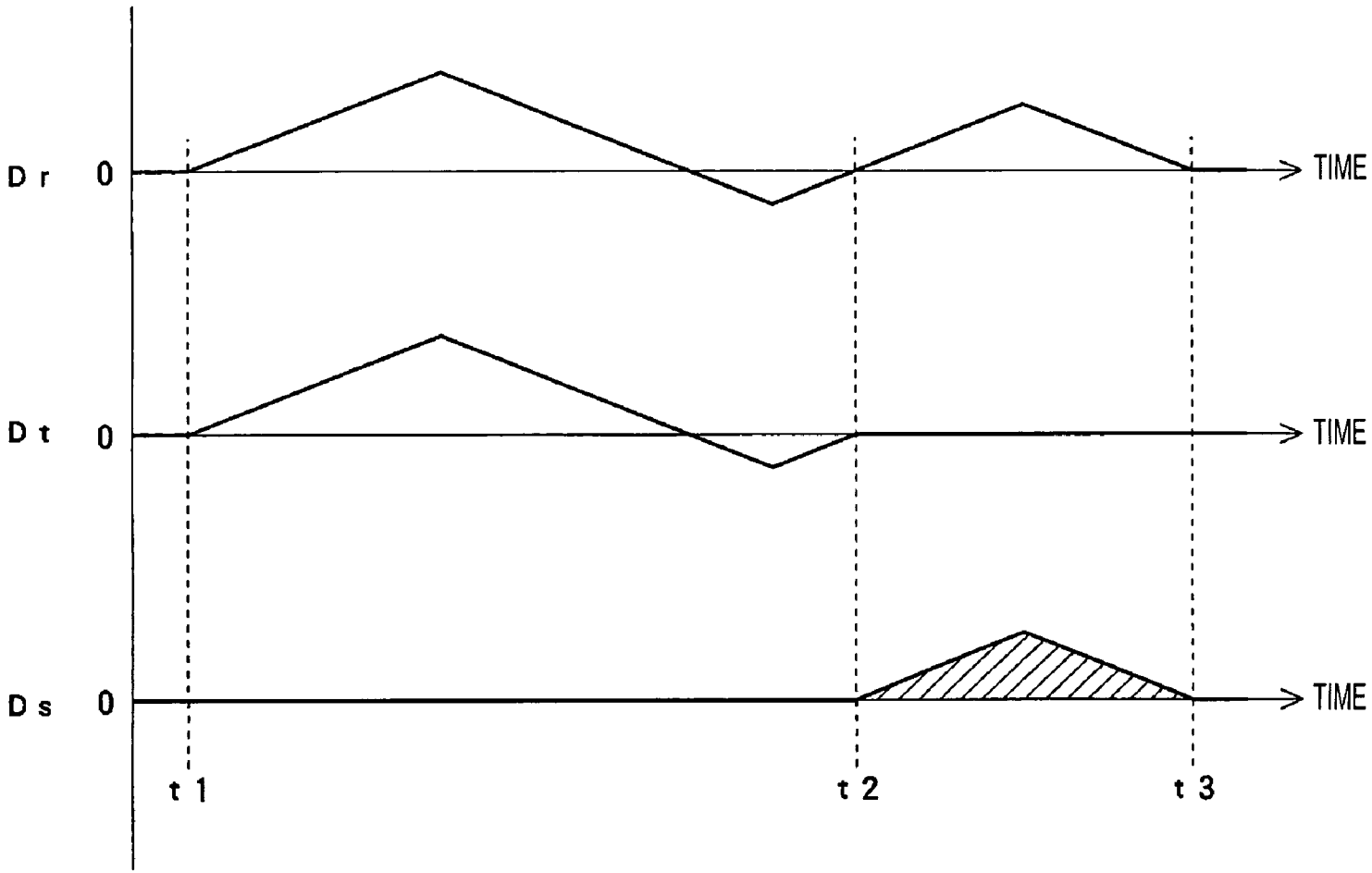
FIG. 17 is a chart showing the sound pickup apparatus shown in FIG. 16.
Figure 18:
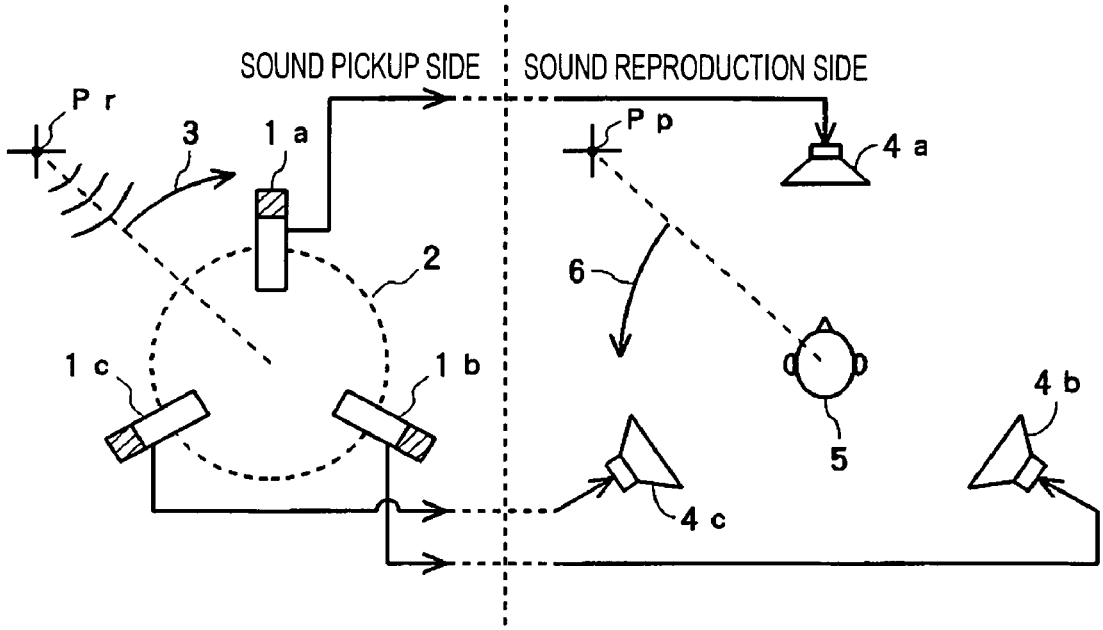
FIG. 18 is a diagram of a sound pickup and reproduction system using a multi-directional microphone system.
Figure 19:
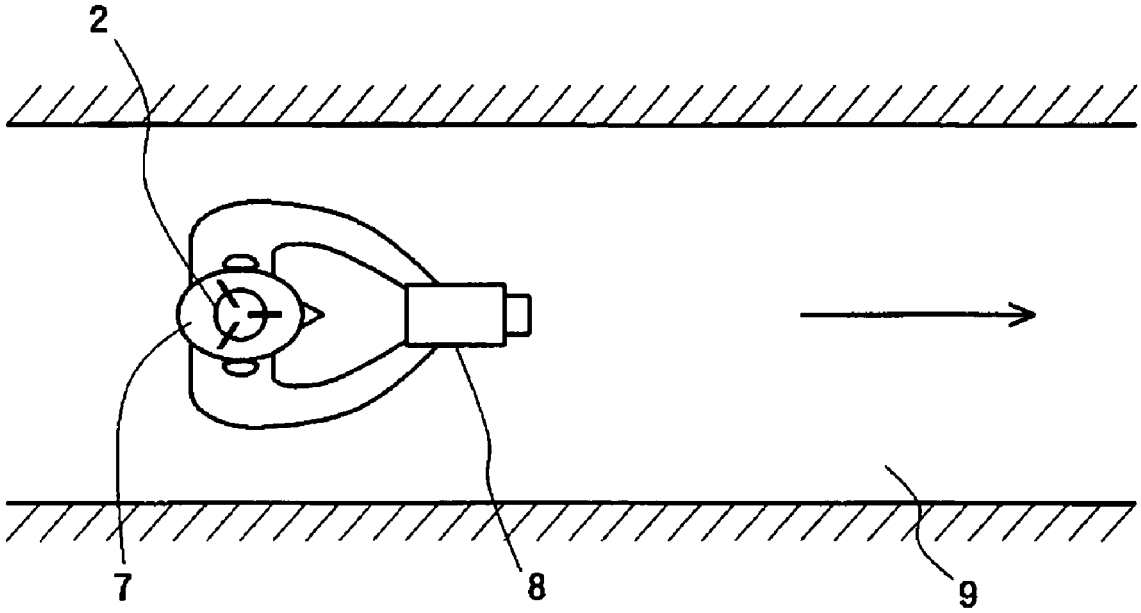
FIG. 19 is an illustration of a change in orientation of microphones.

When the azimuth data Dr and Dt change in the manner shown in FIG. 17, for a period of time from t1 to t2, the microphones 1*a*, 1*b*, and 1*c* are rotated, as indicated by the azimuth data Dr, by a rotation of the body of the recording operator 7, as indicated by the azimuth data Dt. In this period of time, the difference data Ds is zero, indicating that the microphones 1*a*, 1*b*, and 1*c* do not rotate with respect to the body of the recording operator 7. In contrast, for a period of time from t2 to t3, the body of the recording operator 7 does not rotate, as indicated by the azimuth data Dt, whereas, the microphones 1*a*, 1*b*, and 1*c* are rotated, as indicated by the azimuth data Dr, by the change of only the head of the recording operator 7.

In the sound pickup apparatus shown in FIG. 16, the difference data Ds is recorded in the memory 27, instead of the azimuth data Dr shown in FIG. 2 or 3. Other structure is the same as that shown in FIG. 2 or 3. A sound reproduction apparatus and method according to the second embodiment are the same as those according to the first embodiment shown in FIGS. 8 to 15, except that the azimuth data Dr is replaced by the difference data Ds.

In the second embodiment, therefore, a change in orientation of the microphones 1*a*, 1*b*, and 1*c* is not canceled when the change of orientation is caused by a rotation of the body of the recording operator 7. Only when the orientation of the microphones 1*a*, 1*b*, and 1*c* changes with respect to the body of the recording operator 7, the change of orientation is canceled.

Other Embodiments

The sound data picked up by microphones may be transmitted directly to a remote user (listener) without recording it in a recording medium, or the picked-up sound data may be recorded in a recording medium and reproduced from the recording medium before it is transmitted to a remote user (listener) via a network. The sound data may be transmitted to a plurality of users. The sound data may be compressed and encoded before it is transmitted.

While three pickup microphones are used in the foregoing embodiments, two pickup microphones or four or more pickup microphones may be used.

A plurality of microphones are not necessarily integrally formed or integrally rotated. A system for detecting rotation of the individual microphones and processing output sound data according to the detected rotation may be used. In this case, for example, these microphones may be worn separately by a plurality of operators.

It should be understood by those skilled in the art that various modifications, combinations, sub-combinations and alterations may occur depending on design requirements and other factors insofar as they are within the scope of the appended claims or the equivalents thereof.

What is claimed is:

1. A sound pickup method comprising the steps of:

picking up sound using a plurality of microphones, the plurality of microphones being arranged so that respective directivity axes of the plurality of microphones differ from each other or that the plurality of microphones functions as having directivities in different directions by performing a calculation on sound signals output from the plurality of microphones, wherein the plurality of microphones is arranged on an operator's head so as to rotate in correspondence with rotation of the operator's head;

detecting rotation of the plurality of microphones;

processing the sound signals output from the plurality of microphones according to the detected rotation so that a change in orientation of each of the microphones is canceled; and outputting the processed output sound signals.

2. A sound pickup method comprising the steps of:

picking up sound using a plurality of microphones, the plurality of microphones being arranged so that the respective directivity axes of the plurality microphones differ from each other or that the plurality of microphones functions as having directivities in different directions by performing a calculation on sound signals output from the plurality of microphones, wherein the plurality of microphones is arranged on an operator's head so as to rotate in correspondence with rotation of the operator's head;

detecting rotation of the plurality of microphones by a rotation detector arranged on the operator's head so as to rotate in correspondence with the rotation of the operator's head;

outputting information about the detected rotation from the rotation detector and outputting the sound signals output from the plurality of microphones; and providing timing information to associate the sound signals output from the plurality of microphones with the information about the detected rotation from the rotation detector.

3. A sound pickup and reproduction method comprising the steps of:

picking up sound using a plurality of microphones, the plurality of microphones being arranged so that respective directivity axes of the plurality of microphones differ from each other or that the plurality of microphones functions as having directivities in different directions by performing a calculation on sound signals output from the plurality of microphones, wherein the plurality of microphones is arranged on an operator's head so as to rotate in correspondence with rotation of the operator's head;

detecting rotation of the plurality of microphones;

transmitting information about the detected rotation and transmitting the sound signals output from the plurality of microphones;

receiving the transmitted rotation information and the sound signals output from the plurality of microphones; and processing the received sound signals output from the plurality of microphones according to the received rotation information so that a change in orientation of each of the plurality of microphones is canceled.

4. The method according to claim 3, further comprising the step of localizing a sound image outside a listener's head in headphone reproduction.

5. The method according to claim 3, further comprising the step of detecting rotation of a listener's head and canceling movement of a sound field due to the rotation of the listener's head according to the detected rotation of the listener's head in headphone reproduction.

6. A sound pickup apparatus comprising:

a multi-microphone device including a plurality of microphones, the plurality of microphones being arranged so that respective directivity axes of the plurality of microphones differ from each other or that the plurality of microphones functions as having directivities in different directions by performing a calculation on sound signals output from the plurality of microphones, wherein the plurality of microphones is for arranging on an operator's head so as to rotate in correspondence with rotation of the operator's head;

rotation detecting means for detecting rotation of the plurality of microphones of the multi-microphone device resulting from rotation of the operator's head;

calculation processing means for processing a sound signal output from the multi-microphone device according to the rotation detected by the rotation detecting means so that a change in orientation of the multi-microphone device is canceled; and means for transmitting the processed sound signal to an external device.

7. A sound pickup apparatus comprising:

a multi-microphone device including a plurality of microphones, the plurality of microphones being arranged so that respective directivity axes of the plurality of microphones differ from each other or that the a plurality of microphones functions as having directivities in different directions by performing a calculation on sound signals output from the plurality of microphones, wherein the plurality of microphones is for arranging on an operator's head so as to rotate in correspondence with rotation of the operator's head;

rotation detecting means for detecting rotation of the plurality of microphones of the multi-microphone device resulting from rotation of the operator's head, wherein the rotation detecting means is arranged on the operator's head so as to rotate in correspondence with the rotation of the operator's head;

means for associating the sound signals output from the multi-microphone device with information about the rotation detected by the rotation detecting means using timing information; and means for transmitting information about the rotation detected by the rotation detecting means, information about the association by the means for associating of the sound signals output from the multi-microphone device with the information about the rotation from the rotation using the timing information, and the sound signals output from the multi-microphone device to an external device.

8. A sound reproduction apparatus comprising:

means for inputting sound signals output from a plurality of microphones and rotation information indicating rotation of the plurality of microphones, the plurality of microphones being arranged so that respective directivity axes of the microphones differ from each other or that the plurality of microphones functions as having directivities in different directions by performing a calculation on sound signals output from the plurality of microphones, wherein the plurality of microphones is arranged on an operator's head so as to rotate in correspondence with rotation of the operator's head; and reproduction processing means for processing the sound signals output from the plurality of microphones according to the input rotation information so that a change in orientation of the plurality of microphones is canceled.

9. The apparatus according to claim 8, wherein the reproduction processing means localizes a sound image outside a listener's head in headphone reproduction.

10. The apparatus according to claim 8, further comprising rotation detecting means for detecting rotation of a listener's head, wherein the reproduction processing means cancels movement of a sound field due to the rotation of the listener's head according to the rotation detected by the rotation detecting means in headphone reproduction.

11. A sound pickup apparatus comprising:

a multi-microphone device including a plurality of microphones, the plurality of microphones being arranged so that respective directivity axes of the microphones differ from each other or that the plurality of microphones functions as having directivities in different directions by performing a calculation on sound signals output from the plurality of microphones, wherein the plurality of microphones is for arranging on an operator's head so as to rotate in correspondence with rotation of the operator's head;

a rotation detector detecting rotation of the plurality of microphones of the multi-microphone device resulting from rotation of the operator's head;

a calculation processor processing the sound signals output from the multi-microphone device according to the rotation detected by the rotation detector so that a change in orientation of the plurality of microphones of the multi-microphone device is canceled; and a device for transmitting the processed sound signals to an external device.

12. A sound pickup apparatus comprising:

a multi-microphone device including a plurality of microphones, the plurality of microphones being arranged so that respective directivity axes of the microphones differ from each other or that the plurality of microphones functions as having directivities in different directions by performing a calculation on sound signals output from the plurality of microphones, wherein the plurality of microphones is for arranging on an operator's head so as to rotate in correspondence with rotation of the operator's head;

a rotation detector detecting rotation of the plurality of microphones of the multi-microphone device resulting from rotation of the operator's head, wherein the rotation detector is arranged on the operator's head so as to rotate in correspondence with the rotation of the operator's head;

an association device that associates the sound signals output from the multi-microphone device with information about the rotation detected by the rotation detector using timing information; and a device for transmitting information about the rotation detected by the rotation detector, information about the association by the association device of the sound signals output from the multi-microphone device with the information about the rotation detected by the rotation detector using the timing information, and the sound signals output from the multi-microphone device to an external device.

13. A sound reproduction apparatus comprising:

a device inputting sound signals output from a plurality of microphones and rotation information indicating rotation of the plurality of microphones, the plurality of microphones being arranged so that respective directivity axes of the plurality of microphones differ from each other or that the plurality of microphones functions, as having directivities in different directions by performing a calculation on sound signals output from the plurality of microphones, wherein the plurality of microphones is arranged on an operator's head so as to rotate in correspondence with rotation of the operator's head; and a reproduction processor processing the sound signals output from the plurality of microphones according to the input rotation information so that a change in orientation of the plurality of microphones is canceled.

* * * * *